US007069618B2

(12) United States Patent
Valentini

(10) Patent No.: US 7,069,618 B2
(45) Date of Patent: Jul. 4, 2006

(54) APPLIANCE FOR THE VACUUM CLEANING OF DUSTY MATERIAL AND SIMILAR

(76) Inventor: Guido Valentini, Via Gioberti, 2-20132, Milan (IT)

( * ) Notice: Subject to any disclaimer, the term of this patent is extended or adjusted under 35 U.S.C. 154(b) by 190 days.

(21) Appl. No.: 10/154,351

(22) Filed: May 23, 2002

(65) Prior Publication Data

US 2002/0178536 A1 Dec. 5, 2002

(30) Foreign Application Priority Data

May 31, 2001 (IT) ..... MI2001A1154

(51) Int. Cl.
*A47L 9/14* (2006.01)

(52) U.S. Cl. ..... 15/327.2; 15/327.6; 15/352

(58) Field of Classification Search ..... 15/352, 15/327.1, 327.2, 327.6, 314
See application file for complete search history.

(56) References Cited

U.S. PATENT DOCUMENTS 2,639,001 A * 5/1953 Meyerhoefer ..... 15/327.2
2,918,693 A 12/1959 Gasparini
3,568,239 A * 3/1971 Hamrick ..... 15/314
3,588,944 A 6/1971 Fromknecht et al.
3,783,472 A * 1/1974 Mol ..... 15/314
4,356,591 A 11/1982 Lude
5,699,585 A * 12/1997 Tomooka et al. ..... 15/327.2
5,956,803 A 9/1999 Monesson
6,158,080 A * 12/2000 Schlapkohl ..... 15/314
6,560,816 B1 * 5/2003 Harrelson, II ..... 15/314

* cited by examiner

*Primary Examiner*—Theresa T. Snider
(74) *Attorney, Agent, or Firm*—Arnold B. Silverman; Robert A. Diaz; Eckert Seamans Cherin & Mellott, LLC

(57) ABSTRACT

The present invention refers to a vacuum cleaner appliance having a box-like body (1) made up of a top part (2) and a bottom part (3). The top part (2) includes a vacuum cleaning unit (16) provided with filter (20) and the bottom part (3) includes a space (25) for the housing of an extractable filter container (15) and an opening (11) for the intake of dusty air (13) provided in one of its side walls. The bottom part is provided with a side door (8) that is openable for the extraction of the filter container (15).

2 Claims, 3 Drawing Sheets

APPLIANCE FOR THE VACUUM CLEANING OF DUSTY MATERIAL AND SIMILAR

BACKGROUND OF THE INVENTION

1. Field of the Invention

The present invention refers to an appliance for the vacuum cleaning of dust material and similar, in particular for industrial use.

2. Description of the Related Art

Generally, the different types of industrial vacuum cleaners in use provide for a box-shaped casing in order to contain, in addition to a motorised vacuum cleaning unit, suitable filtering systems comprising a bag for the filtering of the dusty air coming from the outside and the containment of the dust.

Such bags are not easily removable from the appliance for their maintenance and/or substitution, since, they are contained within chambers the access to which is possible only by previous removal or opening of a cover that contains the vacuum cleaning unit with relative electric motor and filtering pack, directly associated with the same unit.

The vacuum-cleaning unit in such appliances has sufficient weight to make the removal or opening of the cover difficult and laborious.

For the above described vacuum cleaners the operation of substitution of the filtering bag is thus a quite burdensome and expensive operation both in term of time as well as hard work.

SUMMARY OF THE INVENTION

In view of the state of the art herein described, scope of the present invention is to provide a dust vacuum-cleaning appliance that solves the problems of the known technique.

According to the present invention, such scope is attained by means of a vacuum cleaning appliance comprising a box-like body made up of a top part and a bottom part, said top part including a vacuum cleaning unit provided with filter and said bottom part comprising a housing space for a extractable filter container and an opening for the intake of the dusty air provided in one of its side walls, characterised in that said bottom part is provided with a lateral door openable for the extraction of the filter container.

Owing to the present invention it is possible to obtain a vacuum-cleaning appliance that allows simpler, less laborious and faster operations of substitution of the filter container.

BRIEF DESCRIPTION OF THE DRAWINGS

The characteristics and the advantages of the present invention will become evident from the following detailed description of an embodiment thereof, that is illustrated as a non limiting example in the enclosed drawings, in which.

DETAILED DESCRIPTION

Figure 1:
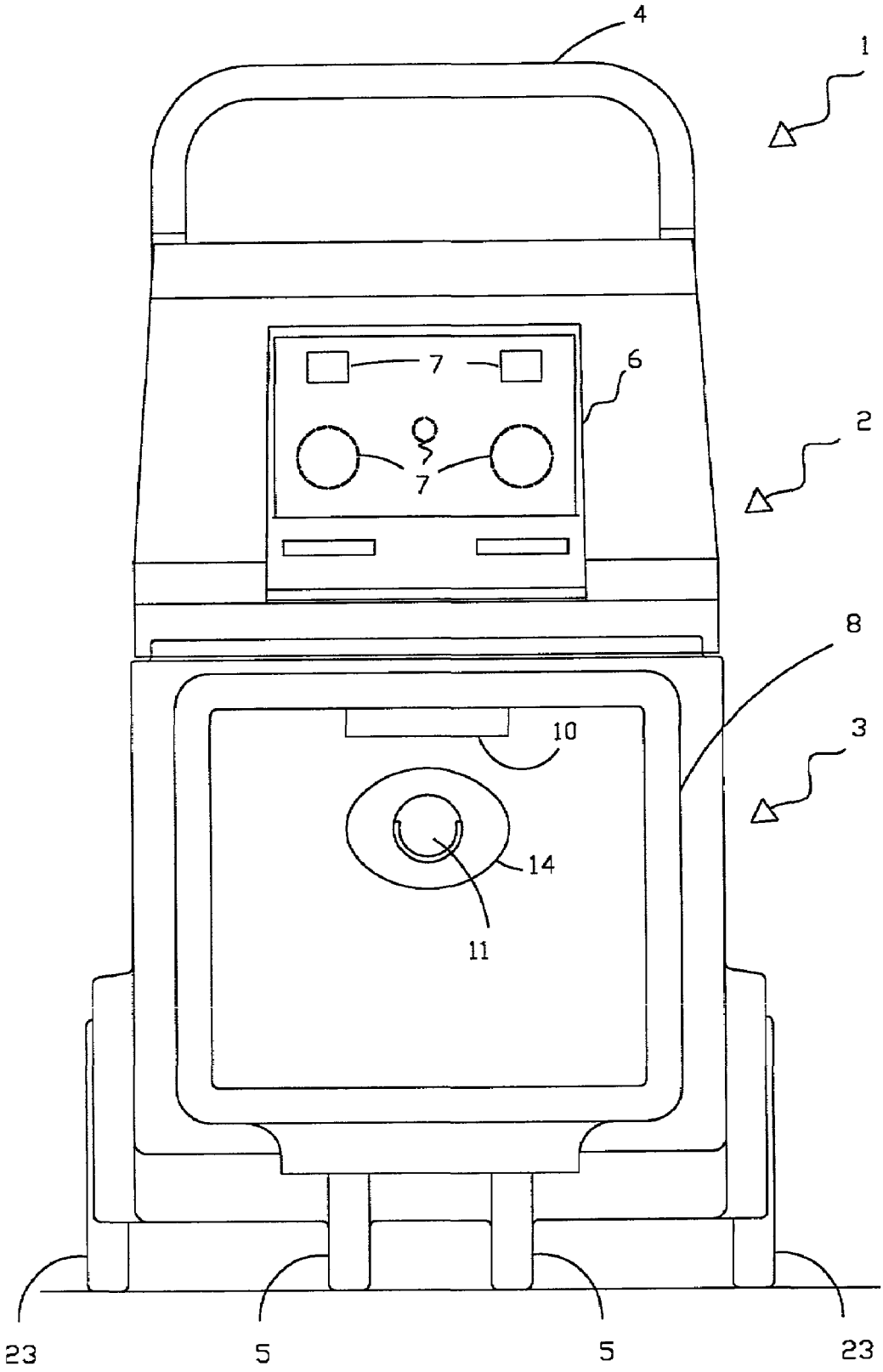
FIG. 1 shows a front view of a vacuum-cleaning appliance according to the present invention.

With reference to the drawings, a vacuum cleaner appliance 1 according to the present invention is shown, that comprises a box-like shaped casing consisting of a top part or cover 2, and of a bottom part 3, that rests on two pair of front 5 and back 23 wheels. There is also provided a handle 4 integral with the bottom part 3.

The top part 2 has an electric control panel 6, suitable to control the operativity of the same vacuum cleaner appliance 1.

The control panel 6 is made up of a plurality of devices 7 suitable to control and to adjust the various functions present in the vacuum cleaner appliance 1.

The top part 2 is housing for a motorised vacuum cleaning unit 16, that has the function to intake the dusty air, and with which a filtering pack 20 is associated.

The bottom part 3 has a door 8, comprising a handle 10, or in another possible embodiment a corresponding handling recess, that allows the 3 opening and closing of said door 8.

Figure 2:
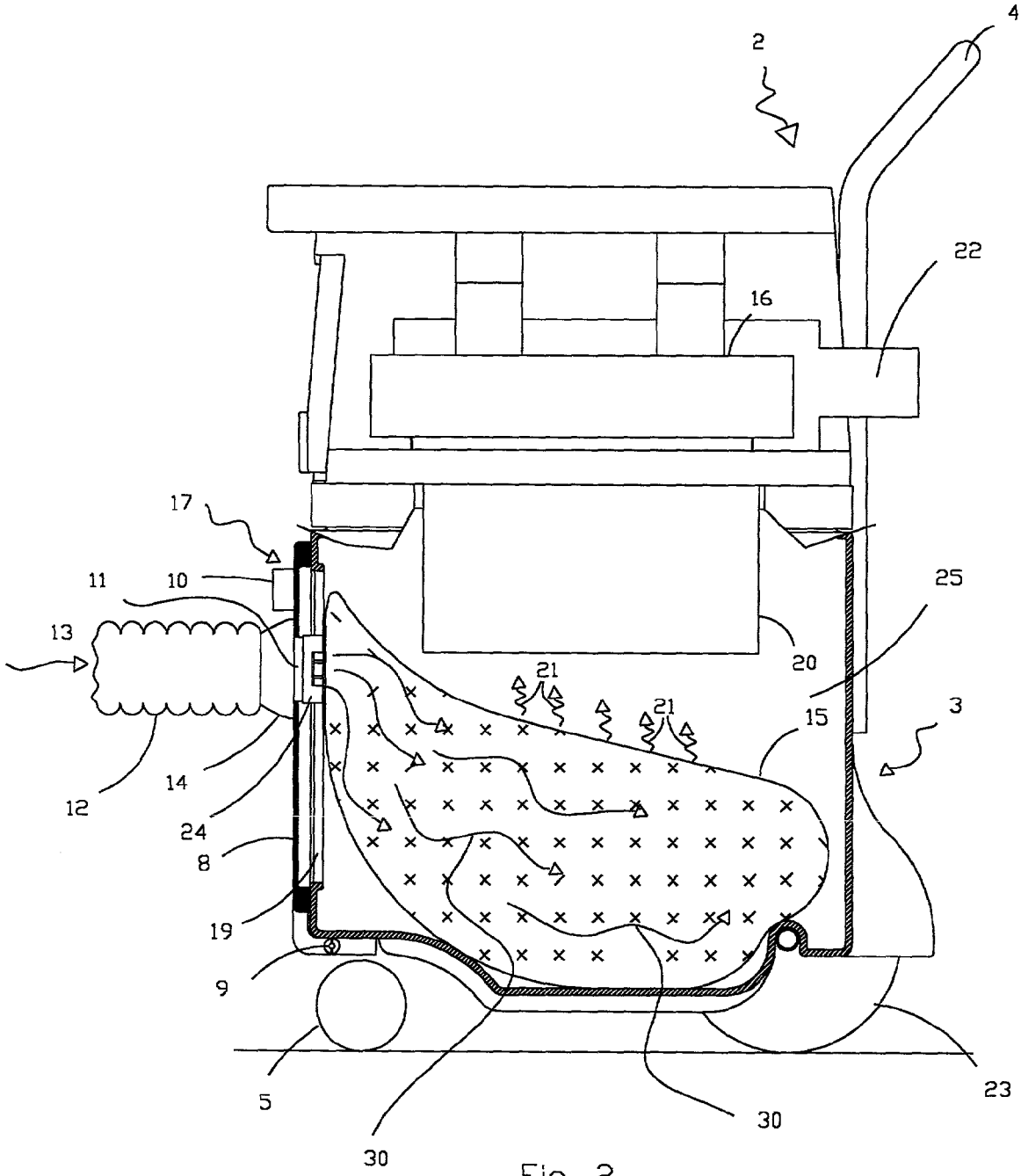
FIG. 2 shows a partially sectioned side view of the vacuum-cleaning appliance in FIG. 1.

In addition the door 8 provides for an opening 11 overlapped by a plastic plate 14, with which a vacuum cleaning tube or hose 12 is connected, as shown in FIG. 2.

Figure 3:
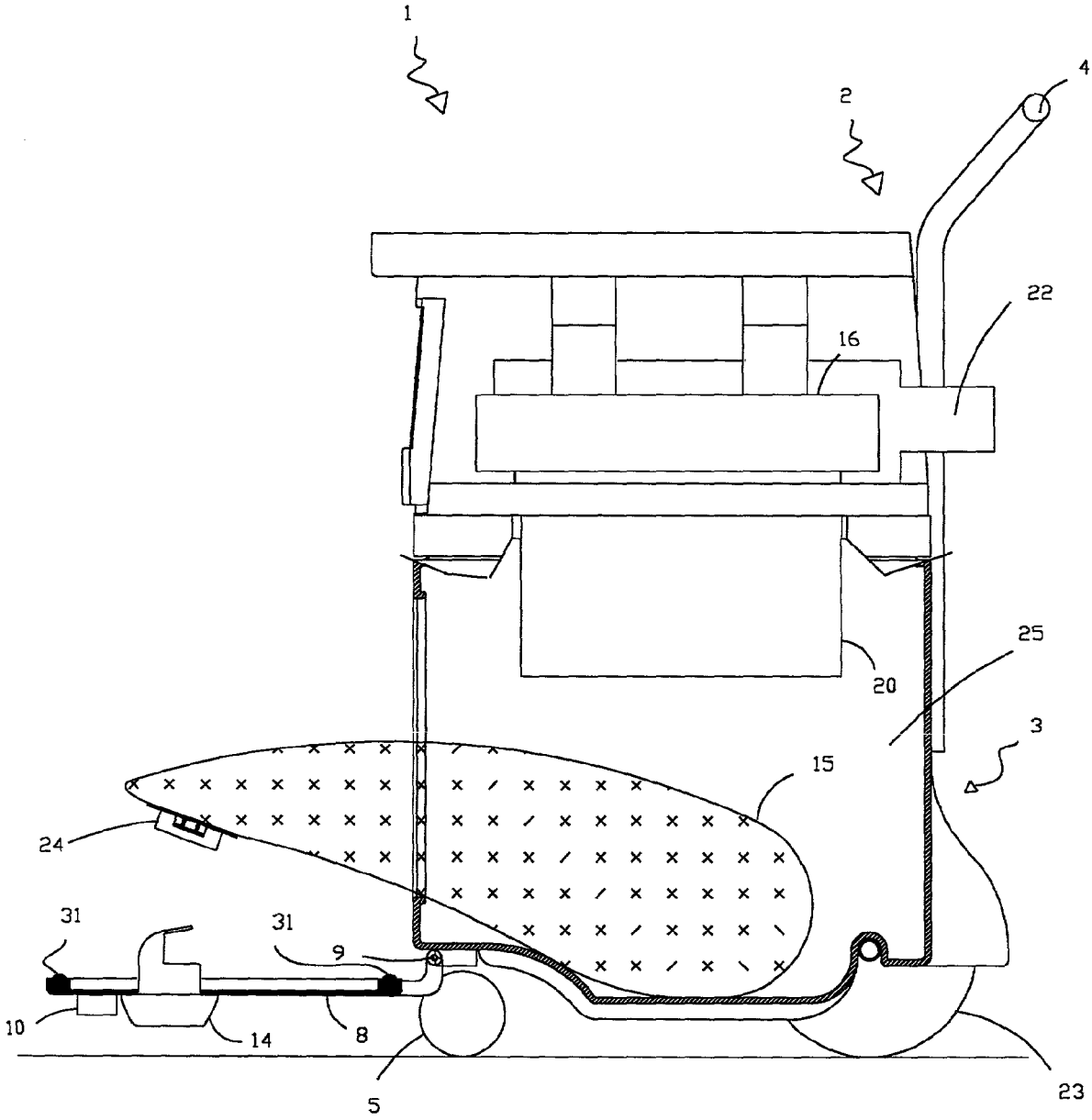
FIG. 3 shows a partially sectioned side view as the one in FIG. 2, but with open door for the removal of the filter container.

Still referring to FIGS. 2 and 3, we can observe that the door 8 has an axis of rotation 9 located in the lower zone of said bottom part 3.

Inside the bottom part 3 a space 25 is defined in which a filter bag 15 is housed and in which the filtering pack 20 is inserted too.

During the operation of the vacuum cleaner appliance 1, referring to FIG. 2, a flow of dusty air 13 coining from the tube or duct 12 enters through the opening 11 in the filter bag 15, where it gets filtered thus leaving its dust content, being said filter bag 15 provided, for instance, with flexible walls of porous material.

The filter bag 15 is provided with a tightness valve 24, as shown in FIG. 3, in order to prevent any dust spill on the outside of the same filter bag 15, in correspondence of its opening 11 for the intake of dusty air 13.

The motorised vacuuming unit 16 provides that the dusty air flow 13 enters said filter bag 15 (arrows 30) and exits purified of the larger size impurities.

The outgoing flow, indicated by a plurality of arrows 21, is attracted towards the filtering pack 20, therefore to be purified also of the smaller size dust residues. Finally the motorised vacuuming unit 16 expels the air through an appropriate expulsion conduit 22.

The door 8 is normally locked by a locking and/or unlocking device 17; the door 8 is in abutment with appropriate packings 31 located on the frame 19 of the bottom part 3.

Once the operation of vacuum cleaning of dusty air is over, a user can actuate the handle 10 so as to unlock the locking and/or unlocking device 17 of the door 8 and to open said door 8, by making it rotate around the axis of rotation 9.

It is necessary to exert just a low force onto the door 8 for its rotation, since what is subject to rotation is just the door 8 and not other organs such as the motorised vacuuming unit 16 and the filtering pack 20.

The rotation action given to the door 8 continues up to a position in which the door 8 is horizontal, in the case in FIG. 3, forming an angle equal to approximately 90°.

The system for the opening of the door 8, referring to FIG. 3, with the latter locked in position of maximum opening, allows a user to extract and to replace the filter bags 15.

The invention claimed is:

1. Vacuum cleaner appliance comprising a box-like body made up of a top part and a bottom part, said top part including a vacuum cleaning unit provided with a filter and said bottom part comprising a space for the housing of an extractable filter bag, said bottom part is provided with an opening adapted to be closed by a door having a lower edge, said lower edge of said door being pivotally secured to the body by a substantially horizontal hinge, the door defining an inlet for the intake of dusty air therein, the inlet being connected to the bag, whereby opening the door results in extraction of the filter bag said bottom part provided with an indentation that rests on an axle of a pair of wheels to permit the vacuum cleaner appliance to be rolled from one location to another location.

2. Vacuum cleaner appliance according to claim 1, wherein:

the vacuum cleaner appliance includes a frame extending at least around the opening adapted to be closed by the door; and said door is provided with means for the locking and/or unlocking with frame of the vacuum cleaner appliance, said locking and/or unlocking means being releasable from the frame of the vacuum cleaner appliance during opening of said door.

* * * * *